US008632657B2

(12) United States Patent
Vehmaa et al.

(10) Patent No.: US 8,632,657 B2
(45) **Date of Patent: *Jan. 21, 2014**

(54) METHOD FOR TREATING LIQUID FLOWS AT A CHEMICAL PULP MILL

(75) Inventors: Janne Vehmaa, Siltakylä (FI); Olavi Pikka, Kotka (FI); Pekka Tervola, Espoo (FI)

(73) Assignee: Andritz Oy, Helsinki (FI)

( * ) Notice: Subject to any disclaimer, the term of this patent is extended or adjusted under 35 U.S.C. 154(b) by 654 days.

This patent is subject to a terminal disclaimer.

(21) Appl. No.: 12/664,719

(22) PCT Filed: Jun. 12, 2008

(86) PCT No.: PCT/FI2008/000065

§ 371 (c)(1),
(2), (4) Date: May 13, 2010

(87) PCT Pub. No.: WO2008/152186

PCT Pub. Date: Dec. 18, 2008

(65) Prior Publication Data

US 2010/0224334 A1 Sep. 9, 2010

(30) Foreign Application Priority Data

| | | |
|---|---|---|
| Jun. 15, 2007 | (FI) | 20070477 |
| Feb. 22, 2008 | (FI) | 20080144 |
| Feb. 22, 2008 | (FI) | 20080145 |
| Apr. 18, 2008 | (FI) | 20080297 |
| Apr. 21, 2008 | (FI) | 20080298 |

(51) Int. Cl.
*D21C 11/00* (2006.01)

(52) U.S. Cl.
CPC ..... *D12C 11/0028* (2013.01)
USPC ..... 162/29

(58) Field of Classification Search
CPC ..... D21C 11/0028
USPC ..... 162/29
See application file for complete search history.

(56) References Cited

U.S. PATENT DOCUMENTS 5,127,992 A * 7/1992 Davies et al. ..... 162/29
5,547,543 A * 8/1996 Nykanen et al. ..... 162/31

(Continued)

FOREIGN PATENT DOCUMENTS

CN 1247248 3/2000
CN 1616761 5/2005

(Continued)

OTHER PUBLICATIONS

Smook, Handbook for Pulp and Paper Technologists, 1992, Angus Wilde Publications, 2nd edition, chapter 26.*

(Continued)

*Primary Examiner* — Anthony Calandra
(74) *Attorney, Agent, or Firm* — Nixon & Vanderhye P.C.

(57) ABSTRACT

A method for treating liquid flows at a chemical pulp mill including at least an alkaline cooking process for producing pulp, treatment of brown stock generated in the cooking, a bleaching plant using ECF-bleaching, in which chloride-containing effluents are formed, an effluent purification plant for treating bleaching plant effluents and other effluents generated at the mill. At least a portion of the effluents is returned after the purification to the pulp production line as source of process water. More than one treatment line is arranged at the effluent purification plant for the mill effluents and effluents with different chemical compositions are purified in separate treatment lines so that the quality and amount of purified water from each treatment line is suitable for use in a stage or stages of the production process, whereto purified effluent is returned.

16 Claims, 3 Drawing Sheets

(56) References Cited

U.S. PATENT DOCUMENTS

| | | | | |
|---|---|---|---|---|
| 5,849,197 | A * | 12/1998 | Taylor et al. | 210/652 |
| 6,569,284 | B1 | 5/2003 | Yin et al. | |
| 2002/0036069 | A1 * | 3/2002 | Kettunen et al. | 162/47 |

FOREIGN PATENT DOCUMENTS

| | | |
|---|---|---|
| CN | 1931749 | 3/2007 |
| EP | 0 356 203 | 2/1990 |
| JP | 2001-115382 | 4/2001 |
| WO | 94/20675 | 9/1994 |

OTHER PUBLICATIONS

Gullichsen editor, Chemical Pulping 6 A and B, 1999, Fapet Oy, p. A635-p. A665 and p. B455.*

Dahl, Evaporation of Acidic Effluent From Kraft Pulp Bleaching, Reuse of the Condensate and Further Processing of the Concentrate, 1999, University of Oulu.*

Duran et al., A new alternative for Kraft E1 effluent treatment, 1994, Biodegrerdation 5, p. 13-19.*

International Search Report mailed Dec. 1, 2009.

Minna Viirimaa et al., "Identification of the Wash Loss Compounds Affecting the ECF Bleaching of Softwood Kraft Pulp", Appita Journal, vol. 55, No. 6, pp. 484-488, Nov. 2002.

* cited by examiner

METHOD FOR TREATING LIQUID FLOWS AT A CHEMICAL PULP MILL

This application is the U.S. national phase of International Application No. PCT/FI2008/000065 filed 12 Jun. 2008 which designated the U.S. and claims priority to Finnish Patent Application Nos. 20080298 filed 21 Apr. 2008, 20080297 filed 18 Apr. 2008, 20080145 filed 22 Feb. 2008, 20080144 filed 22 Feb. 2008 and 20070477 filed 15 Jun. 2007, the entire contents of each of which applications are hereby incorporated by reference.

The present invention relates to a method for treating and utilizing liquid flows at a chemical pulp mill comprising at least an alkaline cooking process for producing pulp, treatment of brown stock generated in the cooking, a bleaching plant using ECF-bleaching, in which chloride-containing effluents are formed, an effluent purification plant for treating bleaching plant effluents and other effluents generated at the mill.

The size of pulp mills has grown intensively during the last years, as today a pulp mill producing 1 million ton/a is of normal size and it does not seem that the growth of the size of pulp mills would be ceasing. At the same time that the size of the pulp mills is growing, the mills are being built in areas and surroundings with very strict environmental regulations. For example, the amount of water used by a mill may have to be strongly restricted. Because the size of the mill grows, minor decreases in the water amounts used by the mill per one ton of pulp do not absolutely decrease the amount of water used by the mill, but the amount is compensated back to the same level as the production size increases. This development is difficult especially in countries where the mill simply does not have enough water available or the water resources should be saved for the needs of people and cultivation. In this kind of situation it is simply impossible to build a mill at a place where other demands of production are easily fulfilled, but due to water resources it is not possible to build a mill. Additionally, in many areas a cleaner environment is desired in such a way that the mills produce substances that are less detrimental to the environment. Therefore, it is essential to look for solutions for finding an increasingly closed process.

Chlorine-containing chemicals have been used throughout the production of chemical pulp in several different forms, of which elemental chlorine $Cl_2$, chlorine dioxide $ClO_2$ and hypochlorite NaOCl or CaOCl are the best known. Chlorine-containing chemicals have been used also e.g. in the form of hypochlorous acid in bleaching, but no permanent applications have remained in use. On the other hand, the chemical pulp industry desired to tightly maintain a technique in which pulp is bleached with chlorine-containing chemicals so that chlorine dioxide is the main chemical of the bleaching process of the mill. Years-long pressure to reduce the amount of organic chlorine compounds in bleaching effluents has led to the point that first the use of chlorine and hypochlorite was abandoned and further the kappa number of the pulp after digestion was decreased from level 30 to level 10-15 for soft wood and from level 16-20 to level 10-13 for hard wood using an oxygen stage. In 1990s, the aim was to abandon the use of chlorine dioxide as well and many mills switched to the use of total chlorine free (TCF) bleaching technique, wherein the use of chlorine dioxide, too, was replaced by totally chlorine-free bleaching chemicals, such as ozone and peroxide. With this technique, the mills got rid of all chlorine-containing chemicals, but on the other hand many paper producers were unsatisfied with the properties of pulp produced without chlorine chemicals. Therefore, the marginal term for all solutions relating to the closing of the mill is that chlorine dioxide is still used as bleaching chemical. Thus, if a mill is to further decrease the amount of organic chlorine compounds, the aim of the mills will be, first and foremost, to treat them inside the mill, rather than to decrease the use of chlorine dioxide.

Modern ECF-bleaching used for bleaching pulp, is typically formed of at least three bleaching stages and three washing apparatuses. In a special case there may be only two washing apparatuses, but such applications are rare. ECF-bleaching covers all such bleaching sequences, which have at least one chlorine dioxide stage and which do not use elemental chlorine in any bleaching stage. Because the use of hypochlorite is due to pulp quality reasons restricted to the production of only a few special pulps, such as dissolving pulps, also hypochlorite is not regarded to be used in the production of ECF-pulp, but it is not totally ruled out. Additionally, the bleaching sequence comprises one alkaline stage, wherein the additional chemicals used are today typically either oxygen, peroxide or both. Further, modern bleachings may use ozone, various types of acid stages and a chelate stage for removing heavy metals. In literature, the bleaching stages are described with letters:

O=oxygen delignification
D=chlorine dioxide stage
H=hypochlorite stage
C=chlorination stage
E=alkaline extraction stage
EO=alkaline extraction stage using oxygen as additional chemical
EO=alkaline extraction stage using peroxide as additional chemical
EOP(PO)=alkaline extraction stage using oxygen and peroxide as additional chemical
P=alkaline peroxide stage
A=acid hydrolysis stage, stage of removal of hexenuronic acids
a=pulp acidation stage
Z=ozone stage
PAA=peracetic acid stage, acid peroxide stage In this patent application the chemical amount and other amounts are given per one ton of air dry pulp (adt pulp, i.e. air dry metric ton of 90% dry chemical pulp).

When bleaching is called ECF-bleaching, the amount of chlorine dioxide used in the bleaching sequence is more than 5 kg act. Cl/adt pulp. If chlorine dioxide is used in one bleaching stage, most typically the doses are between 5-15 kg act. Cl/adt. The doses refer to active chlorine, whereby when converting to chlorine dioxide the dose has to be divided by a ratio of 2.63.

If the use of peroxide in bleaching is restricted to doses smaller than 6 kg and if chlorine dioxide is the main bleaching chemical, so then the chlorine dioxide dose in the bleaching increases from a level of 25 kg/adt depending on the bleaching properties of the pulp and on how much the kappa number of the pulp has been decreased before starting the bleaching using chlorine-containing chemicals. Thus, the bleaching technique may in view of the process be fairly freely adjusted to various levels of chlorine dioxide consumption so that the amount of chlorine-containing chemicals exiting the bleaching corresponds to the capacity of the chemical cycle to receive chlorides.

In connection with the present invention it is in view of practice possible to choose as a reference sequence for hard wood a bleaching sequence ND-EOP-D-P effected with four bleaching stages and leave ozone out. The corresponding sequence for soft wood is D-EOP-D-P. Then the quality of the pulp can be regarded to correspond to the qualities required from ECF-pulp and the pulp yield remains reasonable. Then the chlorine dioxide doses for soft wood are typically between 25-35 kg/adt and for hard wood 20-30 kg/adt. These values can be regarded as design values, and there is no need to invent any new specific techniques for bleaching. The theory of bleaching and various connection alternatives render a possibility for countless different bleaching sequences starting from the connection of two washing apparatuses up to six-stage bleaching sequences. At the same time, the number of chlorine dioxide stages may vary from one up to four and therebetween are alkaline stages as appropriate.

When the amount of active chlorine is calculated as described above in form of the chloride amount, it is noted that even with soft wood, for obtaining a good bleaching result, the bleaching line produces about 10 kg of chlorides per one ton of pulp and a hard wood bleaching line even less. If the plant is closed such that less and less of fresh water is led into bleaching, there may be a need to prepare for chlorine dioxide doses of even 50% greater, and on the other hand the amount of chlorides in bleaching effluents increases up to a level of approximately 15 kg, meaning that in practice the greatest doses of active chlorine are 60-70 kg/adt. Values higher than this cannot be considered economically reasonable, but the basic bleaching solution complies with these starting points.

One suggested technique for decreasing the environmental effects of chlorine-containing chemicals is the closing of the liquids cycles of bleaching plants, and modern bleaching plants have reached to an effluent level of 10-15 $m^3$/adt without a decrease in pulp quality. Nevertheless, even when decreasing the amount of bleaching effluent from a level of 15 $m^3$/adt to a level of 10 $m^3$/adt an increase in chemical consumption is seen, which thus leads to an ever increasing amount of organic chlorine compounds out of bleaching. Thus, a conclusion may be drawn that the closing of the water cycles of bleaching as such does not have a direct influence in the amount of organic chlorine compounds, but on the other hand a smaller amount and a greater concentration of effluents allow for easier and more economical purification thereof.

Chloride-containing chemicals are used in bleaching so that the total chloride dose into the chemical cycle is 5-10 kg of chlorides per one ton of chemical pulp. Because this amount has to be made to pass so that the amount of liquid to be evaporated in the process remains reasonable, the challenge is to find such a process arrangement, where a chloride-containing liquid replaces some other liquid used in a process at the mill. Thus there is no need for separate treatment stages, new non-productive sub-processes at the mill, but the treatment can be carried out by means of existing process stages.

In order to be able to optimize the treatment of a chloride-containing liquid and in practice the treatment of bleaching effluent, it is inevitable to first know the properties of the effluent. In the bleaching, chlorine-containing inorganic compounds and organic chlorine compounds from the reactions of chlorine dioxide or chlorine remain in the process. Bleaching separates from the fibers various compounds of lignin, which remain in the effluent in form of organic molecules. Additionally, sulfuric acid is used in bleaching for pH regulation and as main chemical in the hydrolysis of hexenuronic acids. Sodium hydroxide is also used for pH regulation and lignin extraction in alkaline stages. In addition to these, depending on the bleaching sequence, oxygen and peroxide are used in bleaching, which, however, are in elementary analysis such substances that their contribution in for example purification processes is not noticed. In some special cases, also hydrochloric acid may be used in pH regulation and sulfur dioxide or other reductants in elimination of chemical residuals from the bleaching, i.e. in elimination of unreacted bleaching chemicals.

Closing of the bleaching is based on recycle of filtrates of washing apparatuses from later bleaching stages to preceding stages. The bleaching is planned only for circulating filtrates between bleaching stages and pulp from one stage to another to react with different bleaching chemicals. Thus, closing the whole bleaching is as an idea based on the fact that all substances separated in bleaching end up in filtrates. Optimizing the closing of bleaching is in a great part based on the way how reaction products of bleaching disturb the process of bleaching. Although in many various connections it has been stated that different degrees of closing are possible, practical experience has shown that such washing water arrangements of bleaching where the filtrates are connected so that the amount of effluent is less than 12-13 $m^3$/adt increase the consumption of bleaching chemicals. Naturally, the quality of the pulp and the construction of the bleaching plant dictate the amount of additional chemicals used in the bleaching as the effluent amount of the plant decreases below the above presented level.

Often a research dealing with the closing of bleaching ends in a conclusion that the closing of bleaching succeeds, but the bleaching should be provided with a sink or a kidney in which harmful inorganic substances could be separated from the process. This kind of kidney is often described as a process operating with either membrane technique or ultrafiltration, which again would be a kind of new and separate by-process at the mill. In addition to that, the processes are very new and their continuous technical performance has been questioned. As the above-stated is combined with remarkable operational costs, the technology development has not become general.

Thus, partial closing of bleaching and external purification of the generating filtrates (with a volume of 10-15 $m^3$/adt) using e.g. filtration, various known forms of biological treatment, different techniques of chemical treatment and clarification has been regarded as the so-called best available technology for bleaching effluents. After this, the treated water is led back to the water system to the same channel wherefrom the liquid was taken to the mill process or to a different channel. This is in use at both TCF- and ECF-mills. Biological treatment is efficient specifically when the proportion of detrimental organic substances is decreased, which mainly comprise lignin compounds separated in bleaching, hemicelluloses and components originating from extractives, which constitute a significant portion of effluent coming from the bleaching plant. There is an ample amount of various wood-originating compounds, and part of the compounds are chlorinated and part of them are low-molecular compounds of carbon and hydrogen. As microbes act so that they use as nutrition only the organic portion of effluent, all in-organic substances, at least in-organic elements remain in the effluent. Thus, biologically treated water has an organic load that makes it clearly cleaner than effluent treated in other ways, but due to the in-organic substances the only choice has been to discharge it from the process.

A public research was carried out at the University of Oulu, Finland, on the washing process of pulp bleaching and the operational efficiency of process stages between the washing processes compared to the efficiency of a preceding washing stage (Viirimaa, M., Dahl, O., Niinimäki, J., Ala-Kaila, K. and Perämäki, P. Identification of the wash loss compounds affecting the ECF bleaching of softwood kraft pulp. Appita Journal 55 (2002)6, 484-488). The decrease in the bleaching stage efficiency is observed either as decreased brightness development or as a higher kappa number after a bleaching stage or bleaching stages. According to an essential result of the research, the most important individual component in the filtrate hindering the bleaching is lignin. Based on said research, two conclusions can be drawn: The amount of inorganic substances in a bleaching stage is not essential in view of the bleaching result and by specifically removing the lignin or remarkably decreasing the amount of lignin the bleaching result could be clearly improved and finally reach a bleaching result which is at the same level as in a bleaching plant, the filtrate cycles of which are not closed. This result renders a possibility of significantly optimizing the bleaching process. As the effect of inorganic compounds on chemical consumption is basically not significantly essential, for pulp washing can be accepted a washing water having significant amounts of inorganic compounds. These issues are utilized in the process according to the invention.

SUMMARY OF THE INVENTION

An embodiment of the present invention eliminates said problems and provides a chemical pulp production process, wherein the use of effluents in the pulp production process is possible in such a way that chlorides or other substances disturbing the process are not accumulated in the process in a disturbing way. Additionally, an object of the invention is to treat effluents for returning them by means of a most efficient and technically simple way.

The present invention in one embodiment relates to a method for treating and utilizing liquid flows at a chemical pulp mill comprising at least an alkaline cooking process for producing pulp, treatment of brown stock generated in the cooking, a bleaching plant using ECF-bleaching, in which chloride-containing effluents are formed, an effluent purification plant for treating bleaching plant effluents and other effluents generated at the mill. Characteristic to the method is that at least a portion of the purified effluents is returned after the purification to the pulp production line as a source of process water, whereby more than one treatment line is arranged at the effluent purification plant for the mill effluents, and that effluents with different chemical compositions are purified in separate treatment lines so that the quality and amount of purified water from each treatment line is suitable for use in a stage or stages of the production process, whereto purified effluent is returned.

The quality and amount of purified water from each treatment line is optimized to be suitable for use in a stage or stages of the pulp production process, whereto purified effluent is returned, for obtaining high-quality pulp.

In a preferred embodiment of purification, the washing filtrate after each bleaching stage can in an extreme situation be introduced to a purification process and after the purification process be used in a preceding bleaching stage as washing liquid. Thus, this arrangement would in a three-stage O-A/D-EOP-D bleaching plant lead to a solution in which the washer of the last D-stage receives circulation water or clean water and the filtrate from the D-stage is purified and thereafter returned as a neutral liquid to e.g. the EOP-stage or partly to the EOP-stage and partly to the A/D-stage. The filtrate of the EOP-stage is purified in a dedicated purification line and again returned either countercurrently directly to an A/D washer, or if washing liquid of the last D-stage is returned to the ND washer, then partly to oxygen stage washing. A dedicated purification line is arranged also for the ND filtrate, and from there, too, the purified liquid is returned countercurrently to an oxygen stage washer. If already purified EOP-stage liquid is returned to the oxygen stage washer, then part of the A/D-stage filtrate is delivered thereto, and the rest of said filtrate is returned back to the ND-stage washing device or out of the mill to a water system.

According to a preferred embodiment at least one effluent treatment line is provided with biological treatment. According to an embodiment all purification process lines are such lines, a part of which is some purification based on a biological method. According to an embodiment, part of the purification stages can also be chemical or mechanical. However, fiber removal or enrichment as such is not a method that would fulfill the characteristics of a purification treatment in connection with the present invention.

In addition to this, fractionated washing devices can be utilized. The operating principle of this kind of multi-stage washer is to receive from either one or several washing stages several filtrates, which are then fed as washing liquid to a preceding washing stage, typically to a zone having the same sequence number. Each washing stage is divided into two or more zones, e.g. into three zones, whereby three different filtrates are obtained. Naturally it is also possible to divide various stage into zones in different manner. The formation of filtrates with various purity grades from a fractionating washing device further increases the number of separate purification lines, which naturally necessitates the corresponding increase in the number of effluent treating lines, but on the other hand, a bleaching plant with a higher purity grade is obtained.

Together with this extreme case it is of course possible to use various types of combinations related to filtrate recirculation and purification. Example: a bleaching line with a sequence O-A-EOP-D-P. Then, in accordance with the counter-current principle, the P-stage receives washing liquid from the pulp drying machine, or clean water is fed thereto. The filtrate of the P-stage is introduced counter-currently either with or without fractionation to a washing device of the D-stage. Only the filtrate from the D-stage washer is introduced to the effluent purification plant to one treatment line, after which it is led countercurrently to an EOP-stage washing device or so that half of it is delivered to an A-stage washing device and half to an EOP-stage washing device. In this case, part of the EOP-stage washing liquid can be e.g. condensate. Half of the EOP-stage filtrate is used as washing liquid in the A-stage. Then the purified filtrate of the D-stage is partly used also at the A-stage washer. Outcoming flows from the A and EOP-stages are led to a dedicated purification line, wherefrom the purified flow is returned to the oxygen stage or to the oxygen and the A-stage as washing liquid. Also the portion to be led to the water system is taken from this flow, if any residual remains. As noticed, the amount of organic chlorine compounds introduced to the water system is remarkably small.

The invention, in one embodiment, can be applied in connection with a bleaching sequence O-A-EOP-D-P also such that at least two effluent treatment lines are provided. The effluent is taken out from a D-stage washer and led to purification. Chloride-containing D-stage filtrate is removed from the plant via purification. Additionally, fresh water, condensate and alternatively D-stage purified filtrate is introduced to an EOP-stage washer and circulated countercurrently to an A-stage washer. The filtrate is taken out from the A-stage and led into a second effluent treatment, wherefrom the treated effluent is further led countercurrently to an O-stage and/or back to the A-stage washer. So, the effluent is not taken out from the other treatment line, but it is purified and the countercurrent washing is continued. Thus, in this alternative, purified effluent containing more chlorides is removed from the process, whereas chloride-poor effluent is circulated as washing liquid.

These examples alone with different variations show that arranging the purification process to be part of the bleaching process provides several possible modifications for connecting purification and bleaching stages together.

A remarkable feature of purification stages is their capability of removing metals. When the liquid to be purified is neutralized and led into the treatment basins or reservoirs, then also the metals in the filtrates are neutralized and their solubility is decreased. In that case, during the retention of the purification the metals may be precipitated or otherwise adhere to surfaces or particles in the treatment basin, whereby the purified liquid being returned to the bleaching line contains a remarkably less amount of substances called NPE-substances, such as heavy metals.

This kind of use of a purification system in several different lines enables the introduction of liquid flows from e.g. the woodyard, the drying machine or occasional effluents or any other liquid flow to such a purification line in which they cause the least disturbance to the process. Further, it is possible that one or more purification line treats the bleaching filtrates, and liquids from the woodyard are purified in a separate line.

Because now remarkable changes are obtained in the water arrangements of the whole mill, even the use of evaporation for intensifying the economical balance of the mill is considerable. Then extremely foul effluent fractions, the amount of which, however, is not significant in view of the production of chemical pulp, can even be evaporated, as the so-called chemically harmful fractions can be handled in a biological treatment plant.

Because one starting point in the planning of the plant is chloride-removal in a recovery boiler process, various connection alternatives in the bleaching plant obtain almost complete freedom to lead bleaching plant filtrates or bleaching plant purified filtrates to brown stock washing or different stages of bleaching. The result of this freedom is that almost any known bleaching stages and their combinations can be used for the connections. Of course, returning to e.g. a chlorination stage or a hypochlorite stage in bleaching would lead to an excess amount of chloride being treated, but the invention provides connection alternatives for D, A, Z, P, E, O, and PAA-stages or when combinations of these or other known bleaching stages are made, examples of the best known including: A/D, D/A, Z/D, D/Z, Z/EOP, Z/E etc.

As mentioned, the effluent purification processes can comprise one or several biological treatment stages. If an effluent treatment line does not comprise a biological treatment, then a purification stage may be e.g. chemical, whereby the purpose is to remove e.g. metals by precipitating, whereby also part of the organic substances is removed. Additionally, together with or instead of biological treatment, e.g. some advanced filtration technique can be applied, such as ultrafiltration or a method based on membrane technique or osmosis. According to an embodiment, the invention is advantageous when at least one purification line, from where liquid is returned to the process, is a treatment based on biological treatment. At least a portion of the purified effluent is returned to a washing device of a bleaching process as washing liquid or dilution liquid. Purified liquid can also be returned to the end of the brown stock washing process or to a dilution screw of the last press washing device operating in brown stock washing or to washing devices of different bleaching stages.

If the purification method does not remove chlorides, it is to be noted that the chloride concentration remains essentially unchanged in the flows of the purification plant. Thus, that kind of flows of the purification process are preferably led back to the pulping process (to bleaching and washing stages) in such a way that this fact is taken into account. Optimization of the circulation of chlorine-containing fractions has an effect on the capacity and costs of the chlorine-removal process required in the recovery boiler process.

Technology will offer possibilities, where the conditions and requirements of the mills will have a significant effect on the choice of combinations being applied along with a biological treatment process. When the aim is e.g. the lowest possible color-content, then preferably the fractions with the highest color-content are led to biological treatment and returned to the fiber line. Thus, low-color fractions are purified in a separate plant. The purified liquid fractions are kept separate, and fractions with a low color-content are led into the watercourse. This way, a series of connections is formed which as a whole are optimized in accordance with the legislation of each country to be optimal and best suitable.

The existing various purification methods, some of which have been mentioned and more of which are being developed suitable for different purposes may replace the biological method at some point as the most popular solution. Then the filtrate fraction treatment stages mentioned also in this invention may be chemical purifications, filtration techniques, clarifications or corresponding. In connecting those, too, an essential thing is that the key question will be chloride and the control of the chloride amount. Thus, e.g. U.S. patent application Ser. No. 12/107,877 and the corresponding patent application PCT/FI2008/000053 describe possible techniques in which the chloride removal process of the recovery boiler in connection with ECF-bleaching leads to a result, in which both the pulp production process and the chemical cycle are optimized.

According to a preferred embodiment a portion of the effluents is discharged from the mill. Thus, the effluent is treated also so that it is suitable to be removed from the mill and the AOX-content thereof will essentially decrease and the AOX-emission from the mill is minimized.

According to a preferred embodiment of the invention the majority of bleaching effluents is treated in a dedicated treatment line or lines.

According to a preferred embodiment of the invention the bleaching effluent, which has the highest chlorine compound content, is purified in a dedicated treatment line. Preferably the bleaching effluents are purified in at least two treatment lines such that one line receives for treatment the effluents having a chloride-content lower than 300 mg Cl/l, preferably lower than 250 mg Cl/l, and one line receives the effluents having a chloride-content which effluent exceeds the beforementioned values.

According to a preferred embodiment of the invention, the effluent from the debarking plant is treated separately from the bleaching effluents.

According to a preferred embodiment of the invention, two or more flows are removed from the bleaching plant and they are purified in separate treatments. Preferably, the most contaminated purified flow is led to brown stock washing and cleaner purified flows are led to bleaching.

According to a preferred embodiment of the invention the effluent is purified in order to decrease the lignin-content thereof.

As pulp washing and white liquor production typically require approximately 10-16 $m^3$ of adt liquid, it can be seen that treating and producing such an effluent amount for these needs is advantageous. The environmental requirements that are most essential in view of the whole mill are related to bleaching effluent, which is a significant source of both biological and chemical oxygen consumption. Above all, the organic chlorine compounds generated in ECF-bleaching cause concern. A pulp mill has also other effluent flows, such as cooling waters, sealing waters, reject flows, channel waters, washing waters of the plant and rain waters, as well as wood processing water. With the exception of wood processing water, said water flows have not been in contact with the pulping process. Thus, the emissions accumulated therein are mainly leakages and overflows, occasional emissions caused by apparatus breakages, washing waters of devices, textiles or containers originating from continuous or batch washings, and leakages from the reject system. Based on these determinations, it can be stated that only bleaching effluent contains e.g. chlorinated organic compounds, which commonly are regarded as the most detrimental in view of the environment. Other fractions collected into effluents have not been in the process where chlorine compounds have been present, whereby their detrimental effect to the environment is mainly based to oxygen-consuming compounds, and thus they are not rated as detrimental as organic chlorine compounds.

Our other patent applications have disclosed that effluent fractions containing e.g. organic chlorine compounds are preferably led to brown stock washing or chemical production. Thus the solution according to the present invention, wherein the effluent treatment for various effluent flows takes place in separate departments, is highly advantageous. Thus, a bleaching effluent is treated in separate treatment lines or basins and isolated from e.g. the debarking plant effluents, and on the other hand, the effluent is not diluted as a result of cooling waters or rain waters. Further, if the mill has several separate bleaching lines and several chemical recovery lines, even in that case the flows having the highest chlorine chemical content can be led to a purification unit, from where the purified effluent is returned to mill processes. That way, the organic chlorine compounds can be concentrated in the flow being returned, and on the other hand, less detrimental flows would be purified and led into a nearby water system.

An advantage of separate purification lines is also the control of non-process elements (NPE). As e.g. the water coming from the woodyard contains plenty of substances originating from bark and the surface of the wood, as well as sand and dust adhered thereto during harvesting and transportation, these impurities can end up as detrimental substances in the chemical cycle of the chemical pulp. When bleaching effluents are treated separated from the woodyard effluents in the effluent purification, the effluent returned therefrom contains as impurities only substances that are released in bleaching, chemicals required in the purification process and chemical used in pH regulation.

Via separate purification it is possible to control especially the passing of organic chlorine compounds in the bleaching and out of the bleaching via purification into the water system. As many other flows exiting the mill, such as sealing waters or rain waters, are still very clean even when they end up in the effluent collection system, it is unnecessary to mix these flows with e.g. more contaminated effluents from bleaching or the debarking plant. Thus, e.g. the sealing waters can be recovered and reused, the cooling waters can be circulated in mill processes etc. Only when these waters are contaminated due to e.g. apparatus breakages etc., they are to be collected and led to purification.

As it is advantageous that the amount of effluent from bleaching and water being reused in the process is in equilibrium, this aim also presumes both an ever more efficient circulation of clean water fractions and treatment of various effluent fractions in separate purification lines. An example of this are the rain waters. The mill area may receive rain during several days and the water amount in the runoff area can due to the rain be several cubic meters in an hour. Although the water is mainly clean, it can still unnecessarily dilute the water being passed to purification. Additionally, the rain can flush e.g. sawdust and fibers from the mill area, or from the mill black liquor that has flown onto the floor during a disturbance situation. Thus, the rain water can also cause surprising load peaks for the purification process. Because the mill process is capable of receiving only a certain amount of purified effluent back into the process, load variation caused e.g. by rain would significantly affect the amount and quality of effluents exiting the mill. When the bleaching effluent is treated separately, then the bleaching effluent volume is mainly influenced by only the rain water exiting the bleaching plant and rain water passing into clarifiers, aeration basins and other open constructions. Thus, the runoff area can be minimized and also the volume and load variation are small.

The use of a separate treatment line or basin is advantageous also when oxidized white liquor or white liquor is used in the neutralization of an effluent plant. When the treated effluent has been neutralized and is returned back to the process, the used white liquor is simultaneously recovered and returned to the chemical cycle and the passing of non-process elements to the process is minimized. At the same time it is ensured that compounds capable of disturbing the process are not allowed to enter the chemical cycle via neutralization agents. Thus, unslaked lime, i.e. CaO used at most plants would be clearly more harmful in view of the process and would cause clearly more trouble than white liquor compounds.

An alkaline cooking process, such as a kraft process or a sulfate process or a soda process, is based on batch cooking or continuous cooking comprising a digester or several digesters. Brown stock treatment comprises at least a washing process, and typically oxygen delignification, typically a screening process and washing after oxygen delignification, which washing can comprise one or several washing devices. The screening may be located after digester blowing, in the middle of or after the washing process or after oxygen delignification. These process stages are followed by a bleaching process based on ECF-technique, which comprises a pulp bleaching plant with one or more bleaching stages based on the use of chlorine dioxide in addition to stages using other known bleaching chemicals. The arrangement of the mill also comprises a chemical recovery plant including an evaporation process typically with an in-series connected evaporation plant, a chemical recovery boiler, removal of chlorides from the process, and a chemical production plant for producing cooking chemicals.

According to a preferred embodiment of the invention, purified bleaching plant effluent is used in a last washing stage included in brown stock treatment, and in brown stock treatment the liquid flow is passed counter-currently to evaporation, wherefrom it is led for treatment into a recovery boiler process, wherein a separation process for chlorides is arranged for controlling the chloride level of the liquor cycle.

Thus, according to an embodiment of the invention one or more filtrates of a bleaching sequence can be taken into a purification treatment and returned typically as washing or dilution water to bleaching and/or brown stock washing. The object of use of purified effluent is an objet where this purified effluent is most suitable in view of its composition, such as chemical composition. In an extreme case, the filtrate of each bleaching stage can be treated separately in the purification process and returned to the most suitable object of use.

According to a preferred embodiment of the invention the effluent being returned is heated by means of heat obtained from the effluent being led to purification and heated effluent is used at the chemical pulp mill. Preferably the arrangement comprises a heat exchanger system 30 (FIG. 5), in which the effluent being returned from purification is heated by means of heat obtained from the effluent being led to the purification.

Because the technique presented herein is based on solutions affecting the arrangements of the whole mill and the balance of the whole mill, it is not possible here to define in great detail all the processes which are influenced by the new arrangement. Nevertheless, e.g. literature describes known processes of the whole mill, and the apparatuses and pulp production methods included in this patent application are essentially known per se. Further, the application of the present invention is based on apparatuses known per se. Thus, developing new technical innovations sometime in the future is not necessary for implementing the present invention. The present invention can be implemented at a chemical pulp mill having a digestion process, bleaching, other treatment of pulp, chemical recovery and chemical production comprising various reactors, vessels, pumps, mixers, filters etc. known per se. For instance, the invention is not limited to certain washing devices, but the pulp washing apparatus using purified effluent can be a Drum Displacer™ (DD)-washer, a washing press, a drum washer, suction washer, pressure washer, disc filter or corresponding suitable device for washing pulp.

When the effluent coming from the bleaching plant has been purified in a biological effluent treatment plant representing the newest technologies, the chemical oxygen demand, COD, thereof has decreased by more than 70% and the organic chlorine compounds content by AOX-measuring has decreased by more than 50%. If an anaerobic treatment stage is added to the system, so also the color of the water being treated has decreased remarkably. Thus, this biologically treated water is clearly cleaner than conventionally recycled filtrates in the $D_0$ stage and the first alkaline stage of the bleaching plant. The effluent can also be subjected to chemical purification methods that are based on precipitation or oxidation of oxidizable compounds. The availability of this treated filtrate at the last washing apparatus of the oxygen stage, wherefrom it is passed in remarkable amounts entrained in the pulp to the first stage of bleaching, is much better in view of the organic matter than the use of filtrates from said bleaching stages, for instance from the $D_0$-stage, in bleaching or even in brown stock washing. For instance the technology definition of the European Union dealing with the technology of the forest industry, Bat, i.e. Best Available Technology, defines the object of application of the filtrate from the first alkaline stage to be the washing following the oxygen stage. On the other hand, chemical pulp producers utilizing pressing technology have already during many years diluted pulp only with a filtrate from the $D_0$ stage prior to the $D_0$-stage. Due to this connection, chemical consumption of the bleaching as a whole has increased, but nevertheless it has remained at a level that has in many cases been acceptable.

Also membrane technology can be applied in effluent purification. According to an embodiment, membrane technology can be applied especially after biological and anaerobic purification for effluents or filtrates. There are also embodiments, in which biological treatment and a membrane treatment phase are technically combined in one and the same apparatus.

If the last apparatus before bleaching is a press or a washing press, then the water consumption thereof is divided such that the washing uses in the amount of 3-6 $m^3$/adt liquid and the pulp is discharged from the apparatus at a consistency of higher than 20%, typically at 25-35%. Because after this the situation is such that the pulp is to be diluted prior to bleaching to a pumping consistency of 8-16%, for which purpose the consumption of dilution liquid is 3-6 $m^3$/adt. Now, if both liquids are purified effluent from the purification plant, chlorides are passed into the chemical cycle. If only the dilution liquid is replaced with purified effluent from the purification plant, lignin removal provides remarkable advantages in chemical consumption compared to unpurified filtrates from the bleaching, but then the chemical cycle remains unchanged and chlorides are not passed to the recovery boiler. This can be a recommendable connection when the recovery boiler is not provided with devices by means of which chloride levels can be controlled. If, however, a press-type of washing apparatus is used, purified effluent from the purification plant can be used for washing, and fresh water, filtrate from the bleaching or a mixture of them can be used for dilution.

When treated effluent is used in brown stock washing, part of the compounds of the effluent is passed to the bleaching, especially to the first bleaching stage. As can be noted from these short definitions, the properties of treated effluent are especially preferable in bleaching, specifically in view of the organic substances. However, inorganic substances and especially various forms of chlorine molecule in organic and inorganic forms have prevented the utilization of this effluent at the bleaching plant and specifically in brown stock washing.

Due to the chemical properties of the pulp, the bleaching technology is in a situation where the bleaching effluents are 7-17 $m^3$/adt of effluent so that the AOX emission from the bleaching line is 0.15-0.5 kg/adt and COD 20-40 kg/adt and after purification the AOX is 0.06-0.3 kg/adt and COD 4-15 kg/adt. Thus, it can be stated that if a lower emission level is desired in an economically sustainable way, it will not happen by conventional development of processes aiming at closing. There is a need to determine a technology wherein the whole system is understood in a new way, for instance as described in the present invention.

U.S. patent application Ser. No. 12/107,877 and corresponding patent application PCT/FI2008/000053 describe those preferred techniques for treating chloride-containing bleaching effluents so that they are finally passed into the recovery boiler for combustion and separation. An essential feature of this patent application is that the treatment of chloride-containing liquids in the recovery boiler process does not lead to stronger corrosion and that the recovery boiler process is excellent for separating chloride-containing compounds from the process in order to prevent the accumulation of chlorine. There the chlorine content of flue gases is maximized by increasing the temperature of the combustion zone, where the chloride-containing liquor is combusted. Preferable combustion conditions are determined for the recovery boiler, under which chlorides will start to volatilize into flue gases, and a process location, where the chloride can be removed from the process. More than 30%, preferably more than 40% of the chlorine content of liquor being combusted is evaporated into flue gases, which are treated for removing chloride-containing compounds. Chloride and potassium are enriched in the flue gas ash, wherefrom CI and K can be removed e.g. by methods known per se, which are most typically based on leaching, evaporation-crystallization or cooling crystallization. Thus in the new process the recovery boiler can be made the chloride-sink of the mill and the whole problem caused by chloride is treated there, where it earlier was supposed to be most harmful.

This process arrangement results in a technique that allows leading the filtrates or purified effluent from the bleaching at a mill utilizing ECF-bleaching to the chemical cycle so that between the introduction point of the chloride-containing liquid and the combustion process in the recovery boiler there are no process stages for decreasing the chloride-content prior to the recovery boiler process. Thus, the novel techniques presented herein are based on a mill unity where the recovery boiler process is capable of treating the chloride contained in the normal known ECF-process without a separate separation technique prior to the recovery boiler. Known partial processes connected to the recovery boiler process include e.g. methods based on dissolving or dissolving and re-crystallizing the flue ash of the recovery boiler. In sulfur-free cookings, chlorine removal can be made also from a dissolver or generally from green liquor. A special feature of the present invention is to provide a clearly more closed system compared to previous pulp mill solutions and to present how to utilize the possibilities provided by the recovery boiler technology. The goal of all the presented solutions is:

1. Decreasing the environmental load of the chemical pulp mill.
2. Keeping the use of the pulp mill's chemicals and commodities at least at the present level.
3. Maintaining the pulp quality at the chemical pulp mill at essentially the same level as in the existing processes.
4. Decreasing the amount of water used by the chemical pulp mill.
5. Creating a chemical pulp mill that is eco-efficient as a whole and capable of controlling the liquid flows generated by the mill economically, efficiently and with technically reliable methods.
6. Not removing from the mill such departments or treatment stages in which the environmental load defined by the present BAT is the maximum level of the mill, even when some department is not capable of receiving purified liquid fractions.
7. By combining techniques, to close cycles of the chemical pulp mill to an essentially wider extent than is done at present.
8. Create a concept of a closed chemical pulp mill, wherein the water used by the mill is only cooling water that would be returned back to the water systems in clean form. Other water fractions would essentially originate from the mill recirculations.

ECF-bleaching comprises both acid and alkaline stages. In a typical ECF-bleaching arrangement, a filtrate is discharged as effluent from the first D-stage and from the first alkaline stage. Closing of the bleaching has been studied from many starting points in several publications and the general conclusion has been a level, wherein the connection of the bleaching has been arranged so that a modern ECF-pulp mill produces bleaching effluent in the amount of 6-20 $m^3$/adt, most typically 7-16 $m^3$/adt. When the amount of generated effluent is less than 10 $m^3$/adt, it has been shown that due to the low effluent amount also the use of bleaching chemicals at the mill starts to grow. Thus, it is essential that the bleaching plant receives an adequate amount of such clean or purified water fractions, which do not increase the bleaching chemical consumption.

A bleaching sequence, several of which are determined by the relevant literature in the field starting from either two-stage sequences up to historical seven-stage sequences so that after a first acid combination stage or first acid combination stages follows an alkaline stage and after that at present an acid plus acid stage or an acid plus alkaline stage. Acid stages comprise chlorine dioxide stages, ozone stages, a hexenuronic acid removal stage or some stage based on acid peroxide treatment. An alkaline stage is typically a treatment, wherein the pH is increased to exceed 7 by means of some hydroxide compound, most typically sodium hydroxide, and wherein hydrogen peroxide, oxygen, hypochlorite or some other oxidizing chemical is used as additional chemical. In this kind of arrangement, circulation water originating from a pulp drying process after the bleaching plant is introduced to the last washing apparatus located after all bleaching stages, but it can also be used in earlier stages. As this water originates from the water removal process of the drying machine, it belongs to the internal cycle of the chemical pulp mill and thus does not increase the amount of consumed water.

Brown stock treatment after the cooking process includes a washing process, and typically an oxygen stage, screening and an oxygen stage followed by washing. It is known that this process complex is arranged such that the last washing apparatus in the oxygen stage receives the purest washing liquid for facilitating the bleaching of the pulp, and the filtrate obtained from this last washing apparatus is used in accordance with counter-current washing principles as washing liquid and in dilutions. When the filtrate is recovered from the first brown stock washing apparatus, it is forwarded either directly to a black liquor evaporation plant or it is used in digester plant processes for dilution and displacement, after which it ends up in the black liquor flow.

Effluent purification processes typically comprise pretreatment, neutralization, biological treatment by an aerobic or anaerobic method and possible chemical treatment. It is possible that effluent treatment is solved using a so-called aerated lagoon, whereby the purification efficiency is lower than that of a biological effluent purification process. Finally, clarification is performed, where sludge generated from bacterial activity is removed. This sludge can be delivered further into the recovery boiler for combustion together with black liquor, which is already the practice at many mills. Chemical methods allow precipitating of detrimental substances from the effluent so that the quality of the effluent is improved. Additionally, effluent can be oxidized with e.g. ozone or oxygen. With these methods, a solution for a purification plant can be found, by means of which the effluent is made adequately clean for the presented objects of application.

The neutralization of effluent being purified changes the solubility of inorganic matter in the effluent and simultaneously boosts the thickening of some non-process elements (NPE) during the purification process. The thickened fractions are removed in the clarification together with sludge. Thus, the purification process improves the control of NPE.

Different methods based on microfiltration and membrane technique and osmosis have also been studied, which can also be used in connection with this invention for treating effluent fractions.

In all purification methods it has been stated that chloride-containing inorganic substances are passed out of the mill entrained in liquid, but remarkable amounts of the organic substances are either converted or decomposed as a result of the purification. As the aim is to remove significant amounts of compounds that are detrimental to bleaching, it can be stated that especially biological effluent treatment reaches this goal very well. Because biological effluent treatment removes significant amounts of lignin, the water thus treated is most suitable for the purpose of being used in a brown stock washing process.

For effluent treatment, the effluent has to be cooled first so that the bacteria can act properly. Because the treated water is returned to the process most preferably at process temperature, the system is arranged by means of usual heat exchangers so that one part of an effluent cooler is reserved for the effluent to be cooled and treated effluent acts as a cooling liquid. In such a case the untreated effluent reaches the temperature that is required for effluent treatment, typically below 40° C., and the recycled liquid is heated to a temperature of 65-80° C. so that when the liquid returns to the fiber line, the heating thereof consumes reasonable amounts of steam. When an adequate number of heat exchangers is added to the system, in a most preferable situation e.g. cooling towers can be omitted, which have been used in great numbers for effluent cooling at chemical pulp mills.

Another possibility for heating the treated effluent are the digester plant cycles. The digester plant requires for the coolings a liquid at a temperature of approximately 20-60° C. and warm water or some unheated water fraction of the mill is commonly used for that purpose. If a proper material is selected for the heat exchanger, the cooling can be carried out by means of treated effluent. It is true that treated effluent contains chlorides, but because the pH is neutral or can be adjusted to be even slightly alkaline, the material does not cause an unreasonable cost.

The recycled treated effluent can, due to the presence of bacteria, be assumed to contain remarkable micro-organism activity, which may cause dirt or odor problems. Nevertheless, if the conditions of ECF-bleaching are analyzed in more detail, it can be stated that chlorine dioxide is a strong oxidant and bacterial activity is insignificant in the conditions of chlorine dioxide bleaching. Further, temperatures over 80° C. and change of pH between the bleaching stages from acid to alkaline so that also peroxide is typically present in the stage result in a situation that all remarkable organism activity is almost impossible when the treated effluent reaches the bleaching stage.

Effluents can be introduced to one purification plant from several sources. If there is other wood processing industry in the same industrial area or nearby, typically paper machines, mechanical pulp mills or sawmills, these effluents can still be treated in one and the same purification plant. Additionally, the purification plant can treat municipal waste waters from nearby cities and in some cases also waters from other production plants. In case the purification plant also treats other waste waters in addition to the chemical pulp mill effluents, the quality of elements originating elsewhere than from the pulp mill is to be studied before water from this kind of purification plant is used at the chemical pulp mill. It may e.g. be difficult to use calcium-containing purified effluent in the fiber line due to precipitates, but the use thereof may well be possible in causticizing.

Purified effluent with a certain residual chemical oxygen consumption level and a level of organic halogens (AOX) is passed into the chemical cycle where it is in practice concentrated in evaporation to the form where it is combusted in the recovery boiler. If 90% of the effluent is returned to the chemical cycle after purification, the amount of AOX-level being passed to the water system is also reduced by approximately 90%. Thus, if the AOX amount being passed to the water system after purification would be 0.2 kg/adt, so with the novel arrangement, in which 90% of the purified effluent is recycled to the mill, a level of 0.02 kg/adt is reached. The same reduction can be noted also with chemical oxygen demand. Due to these reasons, the use of purified effluent is a real step towards a closed chemical pulp mill process and allows for an almost pollutant-free process. Nevertheless, it has to be accepted that there are some exceptional situations when effluent can not be recycled from the purification but it has to be temporarily delivered to the water system.

When a sink for the chlorides is arranged, the process is to be arranged such that significant amounts of chloride-containing liquid flows can be fed into the sink so that the sink will remove chlorides to an adequate extent and the chlorides will not be accumulated in any cycle of the mill. Two liquid flows, via which remarkable amounts of chlorides is fed into the liquid cycle being passed into the recovery boiler, can be:

1. Brown stock washing and the chloride passed therefrom to the chemical cycle; and
2. White liquor production and lime mud washing.

Of these, lime mud washing may be successfully carried out partly or completely without bleaching effluent treatment, but in order to carry out the bleaching economically without major chemical additions, it is preferable that the liquid delivered to the bleaching is treated off the substances that cause quality or brightness losses in the bleaching. Thus, bleaching effluents with the dissolved lignins are purified in an external treatment with either mechanical, chemical, biological or oxidizing methods or by means of some combination of methods, where the COD of the effluent is decreased without dilution by at least 30%, preferably more than 40%, most preferably more than 60%, and/or the lignin-content of the effluent is decreased without dilution by at least 30%, preferably more than 40%, most preferably more than 60%. According to the invention, at least one biological treatment is preferably used.

The chemical pulp mill can continue to use chlorine dioxide for guaranteeing the quality of the pulp also in a closed process.

Bleaching chemical consumption remains at essentially the same level as in the best present mill solutions and all targeted brightness levels of the pulp are reached.

SUMMARY OF DRAWINGS

An embodiment of the present invention is to ensure chemical pulping essentially without environmentally detrimental liquid effluents and with very low gaseous and solid emissions. The invention is described in more detail with reference to the accompanying figures, of which

DETAILED DESCRIPTION

Figure 1:
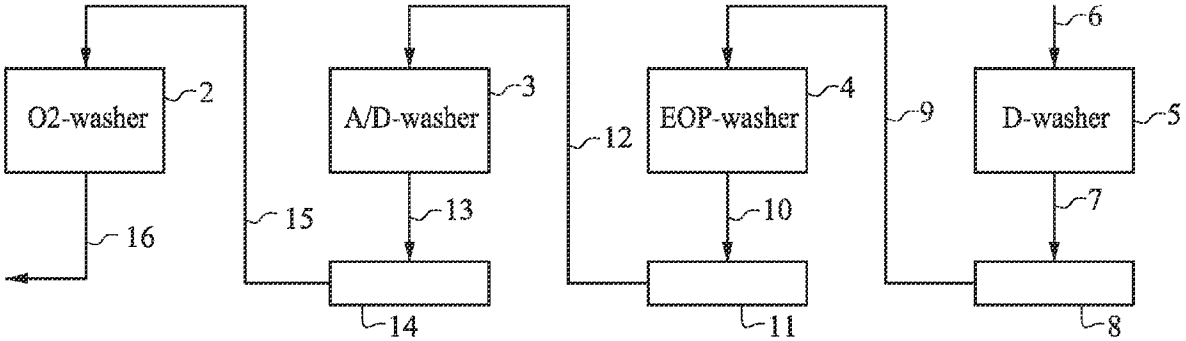
FIG. 1 is a schematic illustration of a preferred embodiment of the invention.

The system illustrated in FIG. 1 describes a bleaching sequence O-ND-EOP-D illustrating washers 2-5 of the sequence only. Washing water is passed countercurrently in relation to the pulp and filtrates received from each washing device are treated in separate purifications. Fresh water, or water from the pulp drying machine or corresponding water is introduced via line 6 to washer 5 of the D-stage. The washing filtrate is taken from wash 5 via line 7 to effluent purification 8. The purified water is used at washer 4 of the EOP-stage, whereto it flows via line 9. The filtrate generated at washer 4 is taken via line 10 to effluent purification 11, and after this treatment further to washer 3 of the A/D stage via line 12. The washer filtrate 13 of the A/D stage is treated in purification 14, wherefrom it is taken via line 15 to an oxygen stage washer for generating filtrate, which is taken via line 16 further to brown stock treatment. Via line 17, the EOP-stage washer receives fresh water or corresponding.

Figure 2:
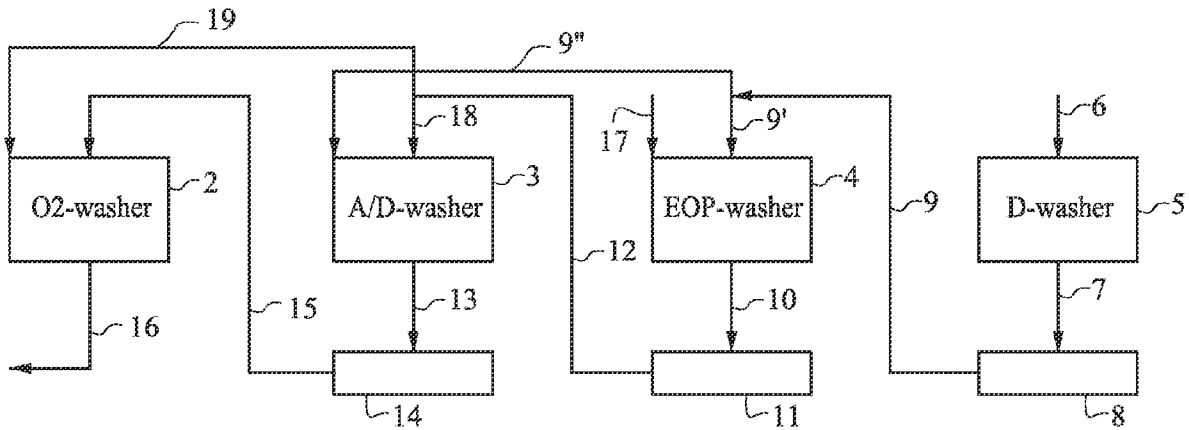
FIG. 2 is a schematic illustration of a preferred embodiment of the present invention.
Figure 3:
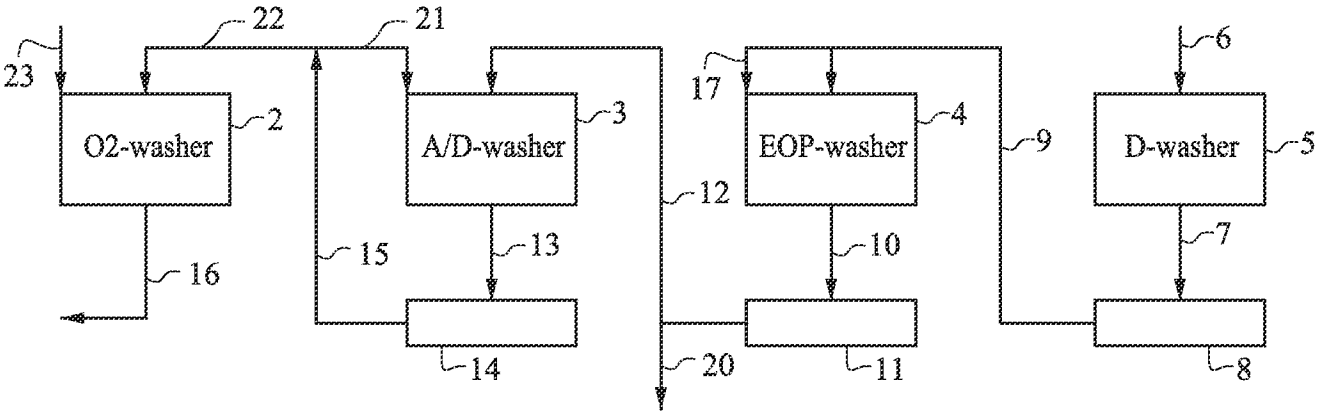
FIG. 3 is a schematic illustration of a preferred embodiment of the present invention.
Figure 4:
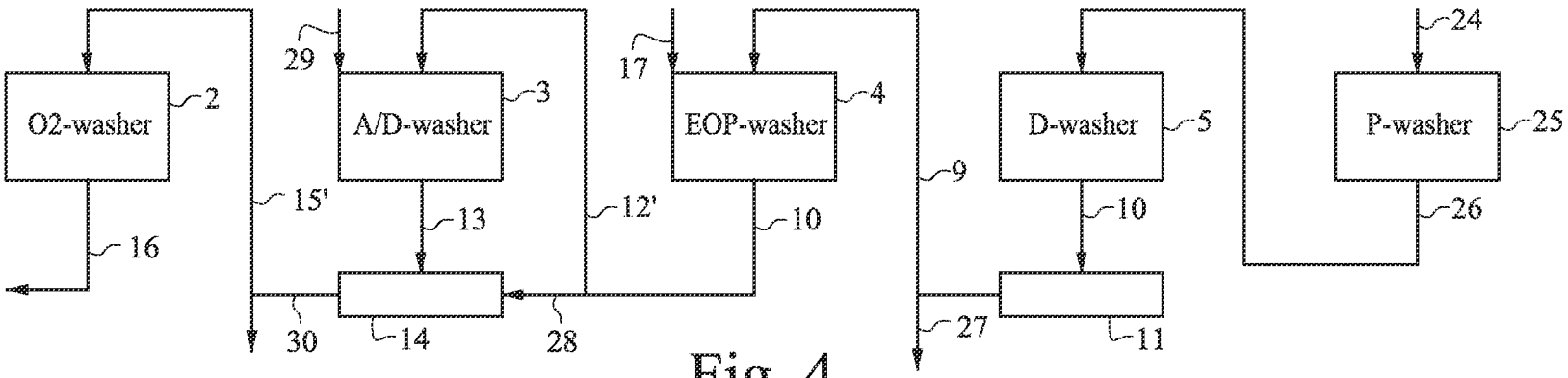
FIG. 4 is a schematic illustration of a preferred embodiment of the present invention.
Figure 5:
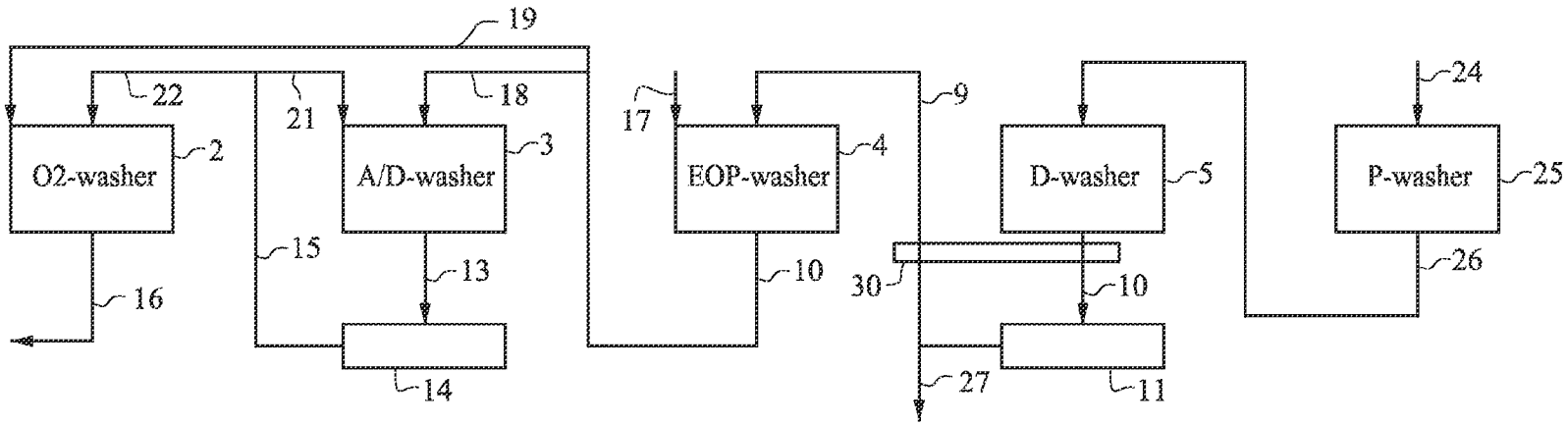
FIG. 5 is a schematic illustration of a preferred embodiment of the present invention.

FIG. 2 also illustrates a bleaching sequence O-ND-EOP-D, and it and latter FIGS. 3-5 uses the same reference numbers as FIG. 1, where appropriate. The difference of this embodiment compared to that of FIG. 1 is that after purification the filtrate obtained from the washer is divided to two different washers for use as washing and/or dilution liquid. The filtrate obtained from the D-stage washer 5 is led from the purification 8 via lines 9 and 9' to the EOP-stage washer and via lines 9 and 9" to the A/D-stage washer for use. Correspondingly, the filtrate 10 of the EOP-stage washer 4 is led after purification 11 via line 12 and further via lines 18 and 19 countercurrently to washer 3 of the A/D-stage and washer 2 of oxygen (O)-stage washer 2, respectively.

In the embodiment according to FIG. 3, washer filtrate is returned after the purification to the same stage to be used as washing liquid. Thus, the A/D-stage washer filtrate in line 13 is taken after the purification 14 via line 15 further partly back via line 21 to the same washer and partly as washing liquid to the preceding pulp wash 2 of the oxygen stage, via line 22. The latter washer typically receives also hot water or condensate via line 23. A portion of the filtrate from the EOP-stage washer located after the A/D-stage (in the pulp flow direction) is removed from the process via line 20 after the purification.

FIG. 4 illustrates a bleaching sequence O-A-EOP-D-P, which has one additional bleaching stage, i.e. peroxide (P)-stage, compared to the embodiments of FIGS. 1-3. Additionally, the initial end of the bleaching does not have a D-treatment in connection with the A-treatment. The P-stage washer 25 is provided with fresh water or corresponding from line 24. The filtrate 26 is taken countercurrently in a way known per se without a separate purification as washing liquid to washer 5 of the D-stage, wherefrom the washing filtrate is taken via line 10 to purification 11. Thus, the effluent of stages D and P is purified in a dedicated line 11, and a portion of it is taken to wash 4 of the EOP-stage via line 12, whereas another portion is discharged from the process via line 27. The A-stage washer receives as washing liquid via line 12' filtrate directly from the EOP-stage washer and additionally hot water or condensate via line 29. The use of purified effluent is implemented also so that the oxygen stage washer 2 receives via line 15' combined effluent of A-stage washing filtrate 13 and EOP-stage washing filtrate 28, which effluent has been purified in a dedicated treatment 14. A portion of the filtrate treated in the purification plant 14 is discharged via line 30. In this arrangement the amount of chlorides to the recovery boiler is small, but sodium and sulfur losses at the recovery boiler are low. Line 27 discharges from the process purified effluent with a higher chloride-content than the effluent discharged via line 30.

FIG. 5 is also an arrangement where the amount of chlorides passed to the recovery boiler is small. In this arrangement the filtrate of the P and D-stages are treated as in connection with FIG. 4. In the embodiment of FIG. 5 the A and EOP-stage is closed by means of the purification of the washing filtrates so that no effluent from these two first stages of the bleaching is delivered to the water system. From the D and P-stages purified effluent is delivered partly to the water system via line 27 and partly to the EOP-stage. In FIG. 5 the filtrate of the EOP-stage is led via lines 18 and 19 to wash 3 of the A-stage and partly to wash 2 of the oxygen stage, respectively. From the effluent purification 14 after the A-stage washing the purified filtrate is partly returned to the A-stage washing and partly taken to wash 2 of the oxygen stage via lines 21 and 22, respectively.

In the solutions of FIGS. 4 and 5 the proportion of AOX is relatively low in the basic solution already, but the arrangement of FIG. 4 is advantageous if the desire is to maintain the sulfur and sodium equilibrium as exactly as possible, without the generation of fly ash to be delivered to landfill.

In the case of FIG. 5, first and foremost the color out of the mill is optimized. Because the color of the filtrate coming from the EOP-stage is high, it is all recovered to the chemical cycle. Additionally, it is possible to remove a significant amount of NPE-substances from the liquid entering the purification via the first fractions.

As can be noticed from the above, the method and apparatus according to the present invention allow decreasing the emissions of a chemical pulp mill to absolute minimum. Although the above description relates to an embodiment that is in the light of present knowledge considered the most preferable, it is clear to a person skilled in the art that the invention can be modified in many different ways within the broadest possible scope defined by the appended claims alone.

The invention claimed is:

1. A method of treating and utilizing liquid flows at a chemical pulp mill comprising:

producing brown stock pulp in an alkaline cooking process;

bleaching the brown stock pulp in a pulp bleaching plant using elemental chlorine free (ECF) bleaching, wherein chloride-containing bleaching effluents are formed by the bleaching;

in a first effluent treatment line, purifying the bleaching effluents with a biological treatment to remove lignin from the effluents, and returning at least a portion of the purified bleach effluents for use as water at a first location in the chemical pulp mill;

in a second effluent treatment line, purifying other effluents produced in bleaching of the pulp, wherein the concentration of chlorides in the other effluents is lower than the concentration of chlorides in the bleaching effluents;

whereby a second effluent treatment line returns the purified other effluents to a second location in the pulp mill separated from the first location.

2. The method according to claim 1, wherein at least a majority of the bleaching effluents produced by the bleaching of the brown stock pulp are purified in the first effluent treatment line and the other effluents in the second effluent treatment line are purified without using any biological treatment.

3. The method according to claim 1, wherein at least twenty percent of the purified bleaching effluent is returned as water to the pulp mill.

4. The method according to claim 1, wherein the effluent purification of the other effluents comprises a biological purification.

5. The method according to claim 1 wherein the purification of the bleaching effluent reduces the lignin-content thereof.

6. The method according to claim 1, wherein the bleaching effluent purification comprises a treatment using membrane filtration technique.

7. The method according to claim 1, wherein the other effluent purification comprises a chemical treatment of the other effluents.

8. The method according to claim 1, wherein the bleaching step includes washing the brown stock in multiple washing stages and the purified bleaching effluents from the first effluent treatment line are introduced in a last washing stage of the multiple wash stages for washing the brown stock.

9. The method according to claim 1, wherein the bleaching step includes washing the brown stock in multiple washing stages and the purified bleaching elements from the first effluent treatment line are introduced to a last washing stage of the multiple washing stages for the washing of the brown stock.

10. The method according to claim 1, wherein the bleaching effluents are purified in at least two effluent treatment lines such that one effluent treatment line receives for treatment the effluents having a chloride-content lower than 300 mg Cl/l and another effluent treatment line receives the effluents having a chloride-content which respectively exceeds the before-mentioned values.

11. The method according to claim 1, wherein oxidized white liquor is used as an alkali source for bleaching.

12. The method according to claim 1, wherein effluent from a debarking plant is purified separately from the purification of the bleaching effluents.

13. A method of treating and utilizing liquid flows at a chemical pulp mill comprising:

producing brown stock pulp in an alkaline cooking process;

bleaching the brown stock pulp in a pulp bleaching plant using elemental chlorine free (ECF) bleaching, wherein chloride-containing bleaching effluents are formed by the bleaching;

in a first effluent treatment line, purifying the bleaching effluents with a biological treatment to remove lignin from the effluents, and returning at least a portion of the purified bleach effluents for use as water at a first location in the chemical pulp mill;

in a second effluent treatment line, purifying other effluents produced in bleaching of the pulp, wherein the concentration of chlorides in the other effluents is lower than the concentration of chlorides in the bleaching effluents;

whereby a first second effluent treatment line returns the purified other effluents for in the pulp mill at a second location separate from the first location, wherein the purified bleach effluents in the first effluent treatment line are heated by heat obtained from the bleach effluents or the other effluents before purification of the bleach effluents or the other effluents.

14. The method according to claim 13, further comprising transferring heat energy from the bleaching effluents flowing through a cross-flow heat exchanger before purification to the bleaching effluents flowing through the cross-flow heat exchanger while flowing from the purification.

15. The method according to claim 1, wherein the purified other effluents flowing through the second effluent treatment line are heated by heat obtained from the digester plant liquid cycles.

16. A method of treating and utilizing liquid flows at a chemical pulp mill comprising:

producing pulp in an alkaline cooking process;

treating brown stock generated by the alkaline cooking process;

bleaching the produced pulp using ECF-bleaching and forming chloride-containing effluents from the bleaching;

purifying the chloride containing effluents in a first effluent treatment line using a biological treatment to remove lignin from the effluents;

purifying in a second effluent treatment line other effluents produced by the chemical pulp mill, wherein the other effluents have a lower amount of chlorides than does the chloride containing effluents; and using at least a portion of the purified chloride containing effluents from the first treatment line as process water for a first stage of the bleaching and using at least a portion of the purified other effluents from the second treatment line as process water for another stage of the bleaching.

* * * * *